US008294738B2

(12) United States Patent
Ahn

(10) Patent No.: US 8,294,738 B2
(45) Date of Patent: Oct. 23, 2012

(54) LIQUID CRYSTAL DISPLAY

(75) Inventor: Jiyoung Ahn, Anyang-si (KR)

(73) Assignee: LG Display Co., Ltd., Seoul (KR)

( * ) Notice: Subject to any disclaimer, the term of this patent is extended or adjusted under 35 U.S.C. 154(b) by 593 days.

(21) Appl. No.: 12/619,658

(22) Filed: Nov. 16, 2009

(65) Prior Publication Data

US 2010/0165002 A1 Jul. 1, 2010

(30) Foreign Application Priority Data

Dec. 26, 2008 (KR) ..... 10-2008-0134150

(51) Int. Cl.
*G09G 5/10* (2006.01)

(52) U.S. Cl. ..... 345/690; 345/38; 345/48; 345/102

(58) Field of Classification Search ..... None
See application file for complete search history.

(56) References Cited

U.S. PATENT DOCUMENTS

2005/0190288 A1* 9/2005 Yamada ..... 348/371
2007/0046587 A1* 3/2007 Takahara ..... 345/76

* cited by examiner

*Primary Examiner* — Muhammad N Edun
(74) *Attorney, Agent, or Firm* — Birch, Stewart, Kolasch & Birch, LLP

(57) ABSTRACT

There is provided a liquid crystal display. A liquid crystal display panel displays an image. An external light sensor senses a color temperature of external light around the liquid crystal display panel. The output luminance of a backlight is controlled in response to an adjustment dimming signal which is varied according to an input image. A gamma curve adjustment circuit restores an original color of the display image irrespective of a change in the viewing environments by modulating input digital video data based on the color temperature of the external light or a relative maximum white luminance for the adjustment dimming signal.

14 Claims, 12 Drawing Sheets

FIG. 6

| Input RGB gray | | | Input RGB XYZ | | | White | | Calculate RGB X' Y' Z' distorted by external light | | | White | | Output RGB gray | | |
|---|---|---|---|---|---|---|---|---|---|---|---|---|---|---|---|
| | | | | | | XYZ | Color temperature | | | | X'Y'Z' | Color temperature | | | |
| R | G | B | R | G | B | W | WT | R | G | B | W' | WT' | R | G | B |
| 0 | 0 | 0 | XR0, YR0, ZR0 | XG0, YG0, ZG0 | XB0, YB0, ZB0 | XW0, YW0, ZW0 | T(0, 0, 0) | X'R0, Y'R0, Z'R0 | X'G0, Y'G0, Z'G0 | X'B0, Y'B0, Z'B0 | X'W0, Y'W0, Z'W0 | T'(0, 0, 0) | 0 | 0 | 0 |
| 1 | 1 | 1 | XR1, YR1, ZR1 | XG1, YG1, ZG1 | XB1, YB1, ZB1 | XW1, YW1, ZW1 | T(1, 1, 1) | X'R1, Y'R1, Z'R1 | X'G1, Y'G1, Z'G1 | X'B1, Y'B1, Z'B1 | X'W1, Y'W1, Z'W1 | T'(1, 1, 1) | 1 | 1 | 1 |
| 127 | 127 | 127 | XR127, YR127 ZR127 | XG127, YG127, ZG127 | XB127, YB127, ZB127 | XW127, YW127, ZW127 | T(127, 127, 127) | X'R127, Y'R127, Z'R127 | X'G127, Y'G127, Z'G127 | X'B127, Y'B127, Z'B127 | X'W127, Y'W127, Z'W127 | T'(127, 127, 127) | 127 | 110 | 105 |
| 253 | 253 | 253 | XR253, YR253, ZR253 | XG253, YG253, ZG253 | XB253, YB253, ZB253 | XW253, YW253, ZW253 | T(253, 253, 253) | X'R253, Y'R253, Z'R253 | X'G253, Y'G253, Z'G253 | X'B253, Y'B253, Z'B253 | X'W253, Y'W253, Z'W253 | T'(253, 253, 253) | 253 | 238 | 234 |
| 254 | 254 | 254 | XR254, YR254, ZR254 | XG254, YG254, ZG254 | XB254, YB254, ZB254 | XW254, YW254, ZW254 | T(254, 254, 254) | X'R254, Y'R254, Z'R254 | X'G254, Y'G254, Z'G254 | X'B254, Y'B254, Z'B254 | X'W254, Y'W254, Z'W254 | T'(254, 254, 254) | 254 | 239 | 234 |
| 254 | 255 | 255 | XR254, YR254, ZR254 | XG255, YG255, ZG255 | XB255, YB255, ZB255 | XW254, YW255, ZW255 | T(254, 255, 255) | X'R254, Y'R254, Z'R254 | X'G255, Y'G255, Z'G255 | X'B255, Y'B255, Z'B255 | X'W254, Y'W255, Z'W255 | T'(254, 255, 255) | 255 | 239 | 235 |
| 255 | 255 | 255 | XR255, YR255, ZR255 | XG255, YG255, ZG255 | XB255, YB255, ZB255 | XW255, YW255, ZW255 | T(255, 255, 255) | X'R255, Y'R255, Z'R255 | X'G255, Y'G255, Z'G255 | X'B255, Y'B255, Z'B255 | X'W255, Y'W255, Z'W255 | T'(255, 255, 255) | 255 | 240 | 235 |
| | | | | | | | | | | | | | Determine Gamma curve of red | Determine Gamma curve of green | Determine Gamma curve of blue |

FIG. 9

| Input RGB gray | | | Input RGB XYZ | | | White | | Calculate RGB X' Y' Z' distorted by external light | | | White | | Output RGB gray | | | |
|---|---|---|---|---|---|---|---|---|---|---|---|---|---|---|---|---|
| | | | | | | XYZ | Color temperature | | | | X' Y' Z' | Color temperature | | | | |
| R | G | B | R | G | B | W | WT | R | G | B | W' | WT' | R | G | B | |
| 0 | 0 | 0 | XR0, YR0, ZR0 | XG0, YG0, ZG0 | XB0, YB0, ZB0 | XW0, YW0, ZW0 | T(0, 0, 0) | X' R0, Y' R0, Z' R0 | X' G0, Y' G0, Z' G0 | X' B0, Y' B0, Z' B0 | X' W0, Y' W0, Z' W0 | T'(0, 0, 0) | 0 | 0 | 0 | Brightness equality mapping or Luminance equality mapping |
| ⋮ | ⋮ | ⋮ | ⋮ | ⋮ | ⋮ | ⋮ | ⋮ | ⋮ | ⋮ | ⋮ | ⋮ | ⋮ | ⋮ | ⋮ | ⋮ | |
| 254 | 255 | 255 | XR254, YR254, ZR254 | XG255, YG255, ZG255 | XB255, YB255, ZB255 | XW254, YW255, ZW255 | T(254, 255, 255) | X' R254, Y' R254, Z' R254 | X' G255 Y' G255, Z' G255 | X' B255, Y' B255, Z' B255 | X' W254, Y' W255, Z' W255 | T'(254, 255, 255) | 255 | 239 | 235 | |
| 255 | 255 | 255 | XR255, YR255, ZR255 | XG255, YG255, ZG255 | XB255, YB255, ZB255 | XW255, YW255, ZW255 | T(255, 255, 255) | X' R255, Y' R255 Z' R255 | X' G255, Y' G255, Z' G255 | X' B255, Y' B255, Z' B255 | X' W255, Y' W255, Z' W255 | T'(255, 255, 255) | 255 | 240 | 235 | Clor mapping |

FIG. 10

| Input RGB gray | | | Input RGB XYZ | | | White | | Calculate RGB X' Y' Z' distorted by external light | | | White | | Output RGB gray | | | |
|---|---|---|---|---|---|---|---|---|---|---|---|---|---|---|---|---|
| | | | | | | XYZ | Color temperature | | | | X' Y' Z' | Color temperature | | | | |
| R | G | B | R | G | B | W | WT | R | G | B | W' | WT' | R | G | B | |
| 0 | 0 | 0 | XR0, YR0, ZR0 | XG0, YG0, ZG0 | XB0, YB0, ZB0 | XW0, YW0, ZW0 | T(0, 0, 0) | X' R0, Y' R0, Z' R0 | X' G0, Y' G0, Z' G0 | X' B0, Y' B0, Z' B0 | X' W0, Y' W0, Z' W0 | T'(0, 0, 0) | 0 | 0 | 0 | Brightness equality mapping or Luminance equality mapping |
| 0 | 0 | 1 | XR0, YR0, ZR1 | XG0, YG0, ZG1 | XB0, YB0, ZB1 | XW0, YW0, ZW1 | T(0, 0, 1) | X' R0, Y' R0, Z' R1 | X' G0, Y' G0, Z' G1 | X' B0, Y' B0, Z' B1 | X' W0, Y' W0, Z' W1 | T'(0, 0, 1) | 0 | 0 | 1 | |
| ⋮ | ⋮ | ⋮ | ⋮ | ⋮ | ⋮ | ⋮ | ⋮ | ⋮ | ⋮ | ⋮ | ⋮ | ⋮ | ⋮ | ⋮ | ⋮ | |
| Rm | Gm | Bm | XRm, YRm, ZRm | XGm, YGm, ZGm | XBm, YBm, ZBm | XWRm, YWGm, ZWBm | T(Rm, Gm, Bm) | X' Rm, Y' Rm, Z' Rm | X' Gm, Y' Gm, Z' Gm | X' Bm, Y' Bm, Z' Bm | X' WRm, Y' WRm, Z' WRm | T'(Rm, Gm, Bm) | Rm | Gm | Bm | |
| ⋮ | ⋮ | ⋮ | ⋮ | ⋮ | ⋮ | ⋮ | ⋮ | ⋮ | ⋮ | ⋮ | ⋮ | ⋮ | ⋮ | ⋮ | ⋮ | |
| 254 | 255 | 255 | XR254, YR254, ZR254 | XG255, YG255, ZG255 | XB255, YB255, ZB255 | XW254, YW255, ZW255 | T(254, 255, 255) | X' R254, Y' R254, Z' R254 | X' G255, Y' G255, Z' G255 | X' B255, Y' B255, Z' B255 | X' W255, Y' W255, Z' W255 | T'(254, 255, 255) | 255 | 239 | 235 | Color equality mapping |
| 255 | 255 | 255 | XR255, YR255, ZR255 | XG255, YG255, ZG255 | XB255, YB255, ZB255 | XW255, YW255, ZW255 | T(255, 255, 255) | X' R255, Y' R255, Z' R255 | X' G255, Y' G255, Z' G255 | X' B255, Y' B255, Z' B255 | X' W255, Y' W255, Z' W255 | T'(255, 255, 255) | 255 | 240 | 235 | |

FIG. 11

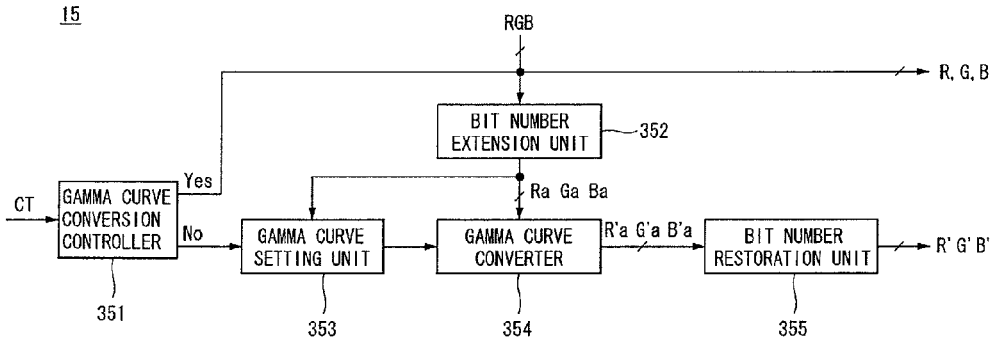

FIG. 12

| Input RGB gray | | | Input RGB XYZ | | | White | | Calculate RGB X' Y' Z' distorted by external light | | | White | | Output RGB gray | | |
|---|---|---|---|---|---|---|---|---|---|---|---|---|---|---|---|
| | | | | | | XYZ | Color temperature | | | | X' Y' Z' | Color temperature | | | |
| Ra | Ga | Ba | Ra | Ga | Ba | W | WT | Ra | Ga | Ba | W' | WT' | R | G | B |
| 0 | 0 | 0 | XR0, YR0, ZR0 | XG0, YG0, ZG0 | XB0, YB0, ZB0 | XW0, YW0, ZW0 | T(0, 0, 0) | X' R0, Y' R0, Z' R0 | X' G0, Y' G0, Z' G0 | X' B0, Y' B0, Z' B0 | X' W0, Y' W0, Z' W0 | T'(0, 0, 0) | 0 | 0 | 0 |
| ⋮ | ⋮ | ⋮ | ⋮ | ⋮ | ⋮ | ⋮ | ⋮ | ⋮ | ⋮ | ⋮ | ⋮ | ⋮ | ⋮ | ⋮ | ⋮ |
| 1023 | 1023 | 1023 | XR1023, YR1023, ZR1023 | XG1023, YG1023, ZG1023 | XB1023, YB1023, ZB1023 | XW1023, YW1023, ZW1023 | T(1023, 1023, 1023) | X' R1023, Y' R1023, Z' R1023 | X' G1023, Y' G1023, Z' G1023 | X' B1023, Y' B1023, Z' B1023 | X' W1023, Y' W1023, Z' W1023 | T'(1023, 1023, 1023) | 255 | 240 | 235 |

LIQUID CRYSTAL DISPLAY

This application claims the priority benefit of Korea Patent Application No. 10-2008-0134150 filed on Dec. 26, 2008, which is incorporated herein by reference for all purposes as if fully set forth herein.

BACKGROUND

1. Field

This document relates to a liquid crystal display capable of improving the distortion of the picture quality according to external light.

2. Related Art

A liquid crystal display displays an image by controlling the light transmittance of a liquid crystal layer in response to a video signal through an electric field which is applied to the liquid crystal layer. The liquid crystal display is a kind of flat display device having the advantages of a small size, slimness, and low power consumption and is being used for portable computers (e.g., notebook PC), office automation devices, and audio/video devices. In particular, an active matrix-type liquid crystal display in which switching elements are formed in respective liquid crystal cells is advantageous in that it can implement motion images because the switching elements can be actively controlled.

A thin film transistor (hereinafter referred to as a 'TFT') as in FIG. 1 is for the most part used as the switching element of the active matrix-type liquid crystal display.

Referring to FIG. 1, the active matrix-type liquid crystal display is configured to convert digital video data into an analog data voltage on the basis of a gamma reference voltage and to supply the converted analog data voltage to a data line DL and a scan pulse to a gate line GL at the same time, thereby charging a liquid crystal cell Clc with the data voltage. To this end, the gate electrode of a TFT is connected to the gate line GL, the source electrode of the TFT is connected to the data line DL, and the drain electrode of the TFT is connected to the pixel electrode of the liquid crystal cell Clc and one of electrodes of a storage capacitor Cst. A common voltage Vcom is supplied to the common electrode of the liquid crystal cell Clc. When the TFT is turned on, the storage capacitor Cst functions to charge a data voltage supplied from the data line DL and to constantly maintain the voltage of the liquid crystal cell Clc. When a scan pulse is supplied to the gate line GL, the TFT is turned on to form a channel between the source electrode and the drain electrode, and so voltage on the data line DL is supplied to the pixel electrode of the liquid crystal cell Clc. At this time, the arrangement of liquid crystal molecules of the liquid crystal cell Clc is changed by an electric field between the pixel electrode and the common electrode, thereby modulating incident light.

A picture quality which is felt by a viewer through this liquid crystal display may be easily distorted according to external environments (the illuminance of external light, the color temperature of external light, etc.). This is because a human's eyes differently feel the color temperature of reference white according to the color temperature (or illuminance) of external light. For example, in a red lighting living room as in FIG. 2, a viewer can recognize white color having slightly red color as 'colorless white color.' Accordingly, a sensitivity for the red color is relatively low, but a sensitivity for blue color (i.e., color corresponding to the red color) is relatively high. On the other hand, in a blue lighting living room as in FIG. 2, a viewer can recognize white color having slightly blue color as 'colorless white color.' Accordingly, a sensitivity for the blue color is relatively low, but a sensitivity for red color (i.e., color corresponding to the blue color) is relatively high.

Such distortion of the picture quality results from the fact that an R gamma curve, a G gamma curve, and a B gamma curve are fixed according to a preset specification (1.8 gamma to 2.2 gamma) irrespective of corresponding viewing environments and maintain a constant color temperature. Consequently, color which is felt through a conventional liquid crystal display is distorted from the original color according to a change in the color temperature (or illuminance) of external light.

SUMMARY

An aspect of this document is to provide a liquid crystal display which is capable of reproducing the original color of a display image irrespective of a change in the viewing environments.

A liquid crystal display according to an embodiment of this document comprises a liquid crystal display panel displaying an image, an external light sensor sensing a color temperature of external light around the liquid crystal display panel, a backlight having an output luminance controlled in response to an adjustment dimming signal which is varied according to an input image, and a gamma curve adjustment circuit restoring an original color of the display image irrespective of a change in viewing environments by modulating input digital video data based on the color temperature of the external light or a relative maximum white luminance for the adjustment dimming signal.

A liquid crystal display according to another embodiment of this document comprises a liquid crystal display panel displaying an image, an external light sensor sensing a color temperature of external light around the liquid crystal display panel, a backlight having an output luminance controlled in response to an adjustment dimming signal which is varied according to an input image, and a gamma curve adjustment circuit restoring an original color of the display image irrespective of a change in viewing environments by varying resistance values of variable resistors constituting a gamma resistance string based on the luminous intensity of the external light or a relative maximum white luminance for the adjustment dimming signal.

BRIEF DESCRIPTION OF THE DRAWINGS

The accompany drawings, which are included to provide a further understanding of this document and are incorporated on and constitute a part of this specification illustrate embodiments of this document and together with the description serve to explain the principles of this document.

In the drawings:

FIG. 6 is a diagram showing an example of a gamma curve setting unit shown in FIG. 5;

FIG. 9 is a diagram showing another example of the gamma curve setting unit shown in FIG. 5;

FIG. 10 is a diagram showing yet another example of the gamma curve setting unit shown in FIG. 5;

FIG. 11 is a diagram showing yet another example of the gamma curve adjustment circuit shown in FIG. 3;

FIG. 12 is a diagram showing further yet another example of the gamma curve setting unit shown in FIG. 11;

DETAILED DESCRIPTION

Hereinafter, embodiments of the present invention are described in detail with reference to FIGS. 3 to 17.

FIGS. 3 to 14 illustrate a liquid crystal display which is capable of reproducing the original color of an input image through a software method (input data modulation) irrespective of a change in the viewing environments.

Figure 1:
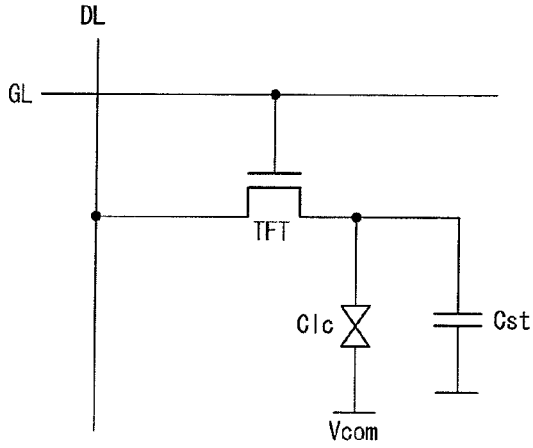
FIG. 1 (Related Art)
FIG. 1 is an equivalent circuit diagram of a pixel of a known liquid crystal display.
Figure 2:
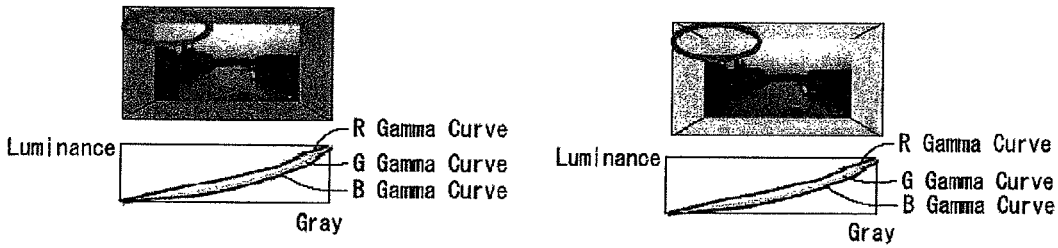
FIG. 2 (Related Art)
FIG. 2 is a diagram illustrating an example in which the color temperature of reference white is differently felt by a human's eyes according to a color temperature (or luminous intensity) of external light.
Figure 3:
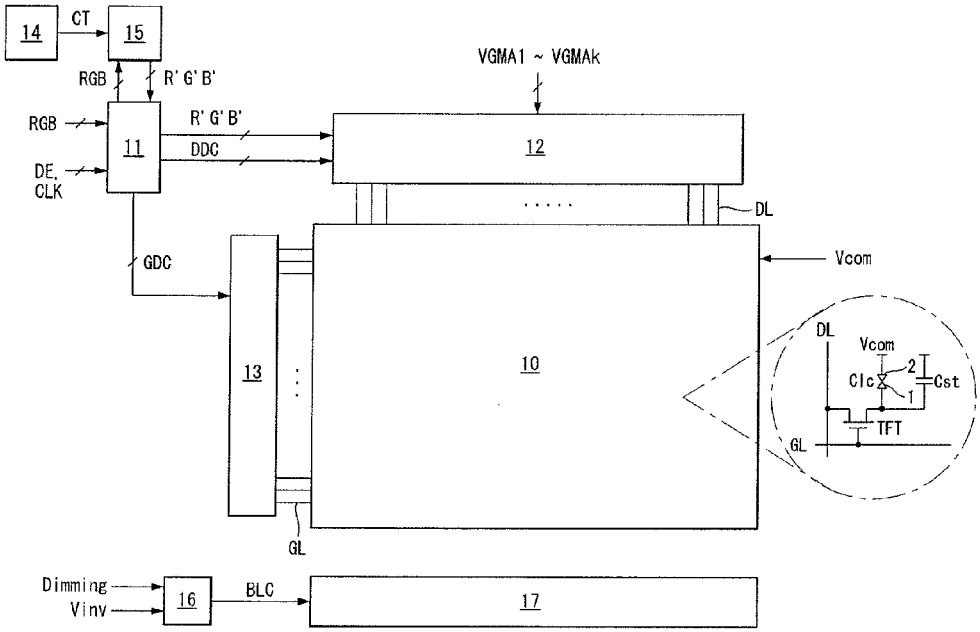
FIG. 3 is a block diagram of a liquid crystal display according to an embodiment of this document.

Referring to FIG. 3, the liquid crystal display according to an embodiment of this document comprises a liquid crystal display panel 10, a timing controller 11, a data driving circuit 12, a gate driving circuit 13, an external light sensor 14, a gamma curve adjustment circuit 15, a backlight driver 16, and a backlight 17.

The liquid crystal display panel 10 comprises a liquid crystal layer formed between two glass sheets. The liquid crystal display panel 10 comprises an m×n number of liquid crystal cells Clc which are arranged in a matrix form by the intersection structure of an m number of data lines DL and an n number of gate lines GL.

The data lines DL, the gate lines GL, TFTs, and storage capacitors Cst are formed in the rear glass sheet of the liquid crystal display panel 10. The liquid crystal cells Clc are coupled to the respective TFTs and are driven by an electric field between pixel electrodes 1 and common electrodes 2. Black matrices, a color filter, and a common electrode 2 are formed in the front glass sheet of the liquid crystal display panel 10. The common electrode 2 may be formed on the front glass sheet in the vertical electric field driving mode, such as a twisted nematic (TN) mode and a vertical alignment (VA) mode, but may be formed on the rear glass sheet along with the pixel electrodes 1 in the horizontal electric field driving mode, such as an in-plane switching (IPS) mode and a fringe field switching (FFS) mode. A polarization plate and an orientation film for setting the pre-tilt angle of liquid crystals are formed on each of the front glass sheet and the rear glass sheet of the liquid crystal display panel 10.

The timing controller 11 receives timing signals, such as a data enable signal DE and a dot clock CLK, from an external system board (not shown) and generates a data control signal DDC for controlling an operation timing of the data driving circuit 12 and a gate control signal GDC for controlling an operation timing of the gate driving circuit 13.

The gate control signal GDC comprises a gate start pulse GSP, a gate shift clock signal GSC, a gate output enable signal GOE, and so on. The data control signal DDC comprises a source start pulse SSP, a source sampling clock signal SSC, a source output enable signal SOE, and a polarity control signal POL, and so on.

Further, the timing controller 11 rearranges modulation digital video data R'G'B' which is received from the gamma curve adjustment circuit 15 according to the resolution of the liquid crystal display panel 10 and supplies the rearranged digital video data to the data driving circuit 12.

In response to the data control signal DDC output from the timing controller 11, the data driving circuit 12 converts the modulation digital video data R'G'B' into an analog gamma compensation voltage with reference to the gamma reference voltages VGMA1 to VGMAk and supplies the converted analog gamma compensation voltage to the data lines DL of the liquid crystal display panel 10 as a data voltage. To this end, the data driving circuit 12 may comprise a number of data drive ICs. Each of the data drive ICs comprises a shift register configured to sample a clock signal, a register configured to temporarily store the modulation digital video data R'G'B', a latch configured to store data for every one line and at the same time output stored data for every one line in response to the clock signal from the shift register, a digital/analog converter configured to select positive/negative-polarity gamma voltages with reference to the gamma reference voltages in response to a digital data value from the latch, a multiplexer configured to select the data lines DL to which the converted analog data is supplied in response to the positive/negative-polarity gamma voltages, and an output buffer connected between the multiplexer and the data line DL.

The gate driving circuit 13 sequentially supplies the gate lines GL with a scan pulse for selecting the horizontal lines of the liquid crystal display panel 10 to which the data voltage will be supplied. To this end, the gate driving circuit 13 may comprise a number of gate drive ICs, each comprising a shift register, a level shifter configured to convert an output signal of the shift register into a signal having a swing width which is suitable to drive the TFT of the liquid crystal cell Clc, and an output buffer connected between the level shifter and the gate line GL.

The external light sensor 14 comprises a known photo sensor and functions to sense external light color temperature (or color coordinate) information CT around the liquid crystal display panel 10. The external light sensor 14 supplies the color temperature information CT to the gamma curve adjustment circuit 15.

The gamma curve adjustment circuit 15 generates the modulation digital video data R'G'B' by adaptively modulating input digital video data RGB based on the external light color temperature CT or the backlight dimming ratio according to an input image so that the original color of the input image which is felt by a viewer can be reproduced as it is irrespective of a change in the viewing environments. The gamma curve adjustment circuit 15 is descried in detail later with reference to FIGS. 4 to 14. Meanwhile, the gamma curve adjustment circuit 15 may also be applied to a liquid crystal display using YCbCr color spaces instead of RGB color spaces. However, an example in which the RGB color spaces are used is described below, for convenience of description.

The backlight driver 16 generates a backlight control signal BLC which matches an input dimming signal Dimming using an operating power Vinv received from the system board. The backlight driver 16 may be replaced with an inverter or a LED drive according to the type of a light source.

The backlight 17 may comprise at least one of a cold cathode fluorescent lamp (CCFL), an external electrode fluorescent lamp (EEFL), and a light-emitting diode (LED).

Figure 4:
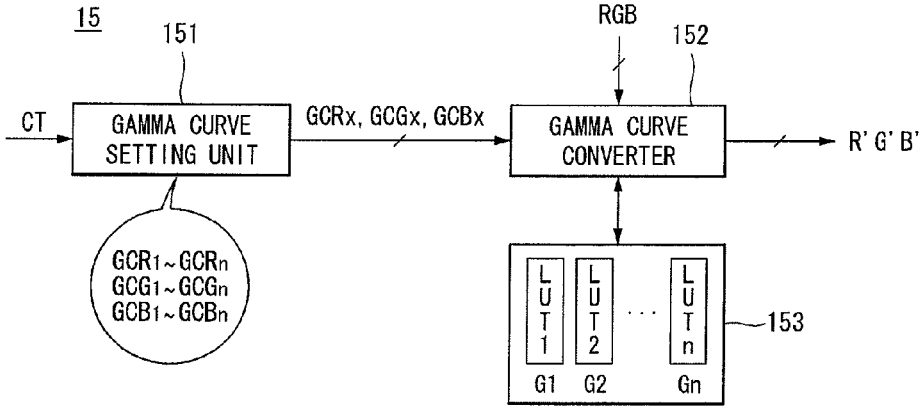
FIG. 4 is a diagram showing an example of a gamma curve adjustment circuit shown in FIG. 3.

FIG. 4 shows an example of the gamma curve adjustment circuit 15.

Referring to FIG. 4, the gamma curve adjustment circuit 15 comprises a gamma curve setting unit 151, a gamma curve converter 152, and a storage unit 153.

The gamma curve setting unit 151 selects and outputs pieces of RGB gamma curve information GCRx, GCGx, and GCBx corresponding to the input color temperature information CT with reference to pieces of R gamma curve information GCR1 to GCRn, pieces of G gamma curve information GCG1 to GCGn, and pieces of B gamma curve information GCB1 to GCBn for every predetermined external light color temperature. For example, the gamma curve setting unit 151 may select and output the pieces of first RGB gamma curve information GCR1, GCG1, and GCB1 in response to a color temperature less than a first reference value A1, the pieces of second RGB gamma curve information GCR2, GCG2, and GCB2 in response to a color temperature of more than the first reference value A1 to less than a second reference value A2, the pieces of third RGB gamma curve information GCR3, GCG3, and GCB3 in response to a color temperature of more than the second reference value A2 to less than a third reference value A3, and the pieces of $n^{th}$ RGB gamma curve information GCRn, GCGn, and GCBn in response to a color temperature of more than an $(n-1)^{th}$ reference value An−1 to less than an $n^{th}$ reference value An. Accordingly, each of the pieces of gamma curve information is determined so that the color of an input image which is felt by a user can be reproduced into its original color in response to an input color temperature.

The storage unit 153 comprises a number of look-up tables LUT1 to LUTn corresponding to the pieces of R gamma curve information GCR1 to GCRn, the pieces of G gamma curve information GCG1 to GCGn, and the pieces of B gamma curve information GCB1 to GCBn, respectively, in a one-to-one manner.

The gamma curve converter 152 selects look-up tables corresponding to the pieces of RGB gamma curve information GCRx, GCGx, and GCBx output by the gamma curve setting unit 151, maps the input digital video data RGB to respective data registered with the selected look-up tables, and generates the modulation digital video data R'G'B'. RGB gamma curves are corrected by the modulation digital video data R'G'B' and are restored into their original states without color distortion.

Figure 5:
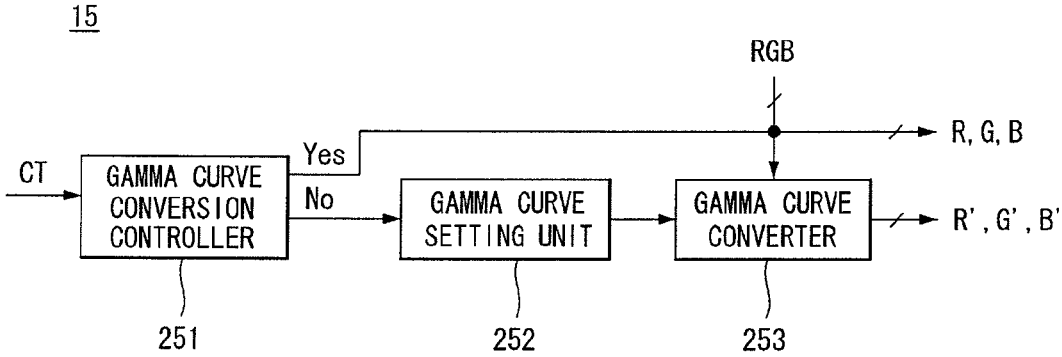
FIG. 5 is a diagram showing another example of the gamma curve adjustment circuit shown in FIG. 3.
Figure 7:
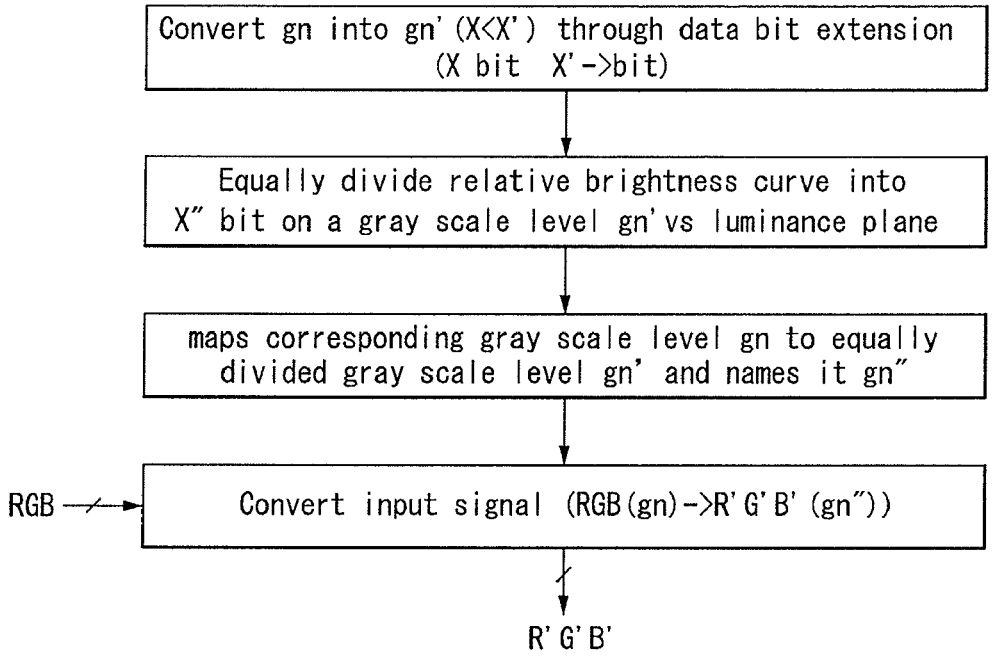
FIG. 7 is a diagram showing an example of a gamma curve converter shown in FIG. 5.
Figure 8A:
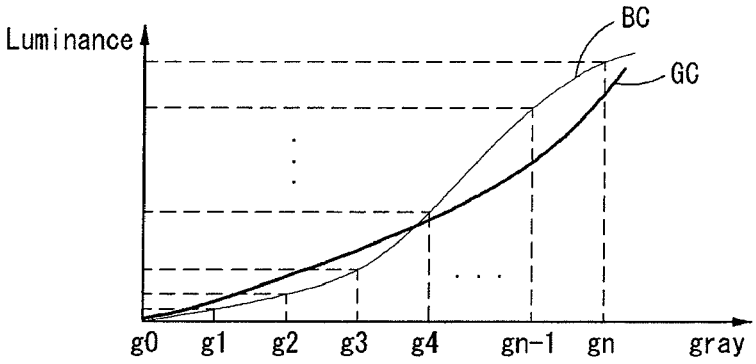
FIGS. 8A to 8C are diagrams showing an operation process of the gamma curve converter according to FIG. 7.
Figure 8B:
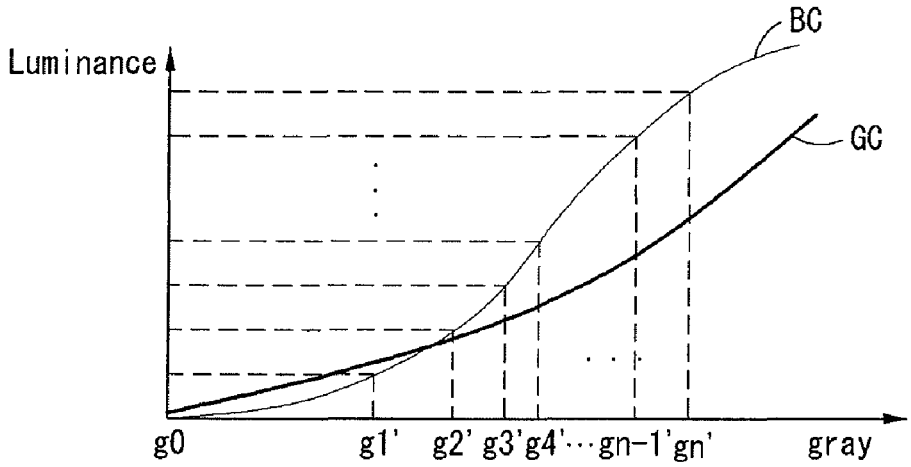
Figure 8C:
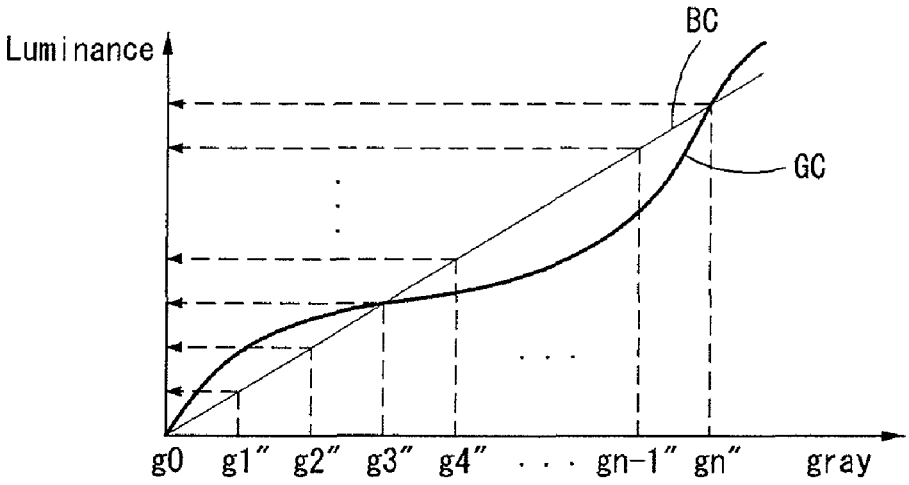

FIG. 5 shows another example of the gamma curve adjustment circuit 15.

Referring to FIG. 5, the gamma curve adjustment circuit 15 comprises a gamma curve conversion controller 251, a gamma curve setting unit 252, and a gamma curve converter 253.

The gamma curve conversion controller 251 determines whether input color temperature information CT received from the external light sensor 14 falls within a predetermined reference color temperature range and, if, as a result of the determination, the input color temperature information CT is determined to fall within the reference color temperature range (Yes), outputs input digital video data RGB as they are without modulation. However, if, as a result of the determination, the input color temperature information CT is determined not to fall within the reference color temperature range, the gamma curve conversion controller 251 generates a signal (No) to instruct the operation of the gamma curve setting unit 252.

The gamma curve setting unit 252 calculates color coordinates X'Y'Z' of input digital video data RGB which have been distorted by external light with respect to all gray scales as in FIG. 6 in response to the operation instruction signal (No) received from the gamma curve setting unit 252 and calculates color coordinates W' and color temperatures WT' of white which has been distorted by the external light based on the calculated color coordinates X'Y'Z'. In an alternative embodiment, the gamma curve setting unit 252 may calculate the color coordinates X'Y'Z' of the input digital video data RGB which have been distorted by external light with respect to specific k gray scales, comprising minimum gray scales (e.g., 0 gray scales) and maximum gray scales (e.g., 255 gray scales), in response to the operation instruction signal (No) received from the gamma curve setting unit 252 and may calculate the color coordinates W' and the color temperatures WT' of white which has been distorted by the external light based on the calculated color coordinates X'Y'Z'. In another alternative embodiment, the gamma curve setting unit 252 may calculate the color coordinates X'Y'Z' of the input digital video data RGB which have been distorted by external light with respect to only maximum gray scales (e.g., 255 gray scales) as in FIG. 9 in response to the operation instruction signal (No) received from the gamma curve setting unit 252 and may calculate the color coordinates W' and the color temperatures WT' of white which has been distorted by the external light based on the calculated color coordinates X'Y'Z'. In yet another alternative embodiment, the gamma curve setting unit 252 may calculate the color coordinates X'Y'Z' of the input digital video data RGB which have been distorted by external light with respect to gray scales exceeding a critical value gray scale (e.g., an m gray scale) as in FIG. 10 in response to the operation instruction signal (No) received from the gamma curve setting unit 252 and may calculate the color coordinates W' and the color temperatures WT' of white which has been distorted by the external light based on the calculated color coordinates X'Y'Z'. Here, the critical value gray scale (e.g., an m gray scale) is a gray scale having the greatest value, from among gray scales which are more sensitive to luminance distortion than to color distortion caused by the external light, and the value may change according to the luminance of a maximum gray scale (e.g., a 255 gray scale). In other words, the critical value of the gray scale (the m gray scale) is small with the higher luminance of the maximum gray scale (the 255 gray scale), but is great with the lower luminance of the maximum gray scale (the 255 gray scale).

The gamma curve setting unit 252 may calculate distorted color coordinates X'Y'Z' of the input digital video data RGB using a variety of methods. For example, the gamma curve setting unit 252 may calculate distorted color coordinates X'Y'Z' of the input digital video data RGB using k*e {(*luminosity factor characteristic for every wavelength*)*(*transmission or reflectance characteristic for every wavelength*)*(*reflected light or transmission light modified by external light*)}. In an alternative embodiment, the gamma curve setting unit 252 may calculate distorted color coordinates X'Y'Z' of the input digital video data RGB using a function (i.e., X'=X+Xa, Y'=Y+Ya, and Z'=Z+Za when X, Y, and Z of light which are reflected, diffracted, and refracted by external light and are then recognized by a human's eyes when a signal is not applied to the display device are Xa, Ya, and Za, respectively. Next, the gamma curve setting unit 252 determines a RGB gray scale set which is the closest to the color coordinate W of original white by the input digital video data RGB, from among the color coordinates W' of white that have been distorted by the external light, as an output RGB gray scale and in real time determines an R gamma curve, a G gamma curve, and a B gamma curve for compensating for distorted colors into their original states with respect to any one of all gray scales, specific k gray scales, maximum gray scales, and gray scales exceeding a critical gray scale based on the determined RGB gray scale set.

The gamma curve converter 253 may generate the modulation digital video data R'G'B' by mapping the input digital video data RGB to output data of all the gray scales which are determined in real time by the gamma curve setting unit 252 of FIG. 6 in a one-to-one manner (all gray scale color mapping). In an alternative embodiment, the gamma curve converter 253 may generate the modulation digital video data R'G'B' by mapping the input digital video data RGB to output data of specific k gray scales which are determined in real time by the gamma curve setting unit 252 in a one-to-one manner (specific k gray scale color mapping). In this case, the gamma curve converter 253 may map the input digital video data RGB to the output data of the specific k gray scales with respect to gray scales which have not been color-mapped other than the specific k gray scales using a 'brightness function' as in FIGS. 7 and 8A to 8C. In more detail, the gamma curve converter 253 converts the level number of gray scales from g0 to gn into g0' to gn' through data bit extension (x bit →x' bit, x<x') (refer to FIGS. 8A and 8B), as in FIG. 7. For example, if 8-bit input data is extended into 10-bit data, the level number of gray scales is converted from 256 into 1024. Next, the gamma curve converter 253 equally divides a relative brightness curve BC into x" bits x"≦x on the converted gray scale levels (g0' to gn')-luminance plane. For example, the relative brightness curve BC may be equally divided into 8 bits. The gamma curve converter 253 maps corresponding gray scale levels g0 to gn to the respective divided gray scale levels g0' to gn' and names the mapped gray scale levels respective gray scale levels g0" to gn" (refer to FIG. 8C). The gamma curve converter 253 modulates the input digital video data RGB corresponding to gray scales other than the specific k gray levels according to the named gray scale levels g0" to gn" and outputs the modulation digital video data R'G'B' (gray scale equality dividing mapping other than specific k gray levels). In another alternative embodiment, the gamma curve converter 253 may generate the modulation digital video data R'G'B' by mapping the input digital video data RGB to the output data of maximum gray scales (e.g., 255 gray scales) which are in real time determined by the gamma curve setting unit 252 of FIG. 9 in a one-to-one manner (maximum gray scale color mapping). In this case, the gamma curve converter 253 may perform 'luminance equality mapping' or 'brightness equality mapping with external light taken into consideration' for the remaining gray scales that have not been subject to color mapping so that the gamma curve of each of the input digital video data RGB has a specific curve (e.g., 2.2 gamma) (the remaining gray scale luminance or brightness mapping). In yet another alternative embodiment, the gamma curve converter 253 may generate the modulation digital video data R'G'B' by mapping the input digital video data RGB to the output data of gray scales exceeding a critical value, from among gray scales which are in real time determined by the gamma curve setting unit 252 of FIG. 10, in a one-to-one manner (gray scale color mapping exceeding a critical value). In this case, the gamma curve converter 253 may perform 'luminance equality mapping' or 'brightness equality mapping with external light taken into consideration' for minimum gray scales to gray scales exceeding a critical value which have not been subject to color mapping so that the gamma curve of each of the input digital video data RGB has a specific curve (e.g., 2.2 gamma) (minimum gray scale to critical value gray scale luminance or brightness mapping).

FIG. 11 shows yet another example of the gamma curve adjustment circuit 15.

Referring to FIG. 11, the gamma curve adjustment circuit 15 comprises a gamma curve conversion controller 351, a bit number extension unit 352, a gamma curve setting unit 353, a gamma curve converter 354, and a bit number restoration unit 355.

The gamma curve conversion controller 351 determines whether the input color temperature information CT received from the external light sensor 14 falls within a predetermined reference color temperature range and if, as a result of the determination, the input color temperature information CT is determined to fall within the reference color temperature range (Yes), outputs the input digital video data RGB as they are without modulation. However, if, as a result of the determination, the input color temperature information CT is determined not to fall within the reference color temperature range, the gamma curve conversion controller 351 generates a signal (No) to instruct the operation of the bit number extension unit 352 and the gamma curve setting unit 353.

The bit number extension unit 352 extends the bit number of the input digital video data RGB in response to the operation instruction signal (No) received from the gamma curve conversion controller 351. For example, the bit number extension unit 352 may extend 8-bit input data into 10-bit data. The reason why the bit number is extended as described above is to reduce the loss of gray scales which will be caused by subsequent data mapping to a minimum.

The gamma curve setting unit 353, as in FIG. 12, calculates the color coordinates X'Y'Z' of input digital video data RaGaBa which have been distorted by external light with respect to all gray scales having an increased level number and calculates color coordinates W' and color temperatures WT' of white which has been distorted by the external light based on the calculated color coordinates X'Y'Z'. In an alternative embodiment, the gamma curve setting unit 353 may calculate the color coordinates X'Y'Z' of the input digital video data RaGaBa which have been distorted by external light in any one of specific k gray scales, maximum gray scales as in FIG. 9, and gray scales exceeding a critical value as in FIG. 10 in the state in which the level number of gray scales are increased and may calculate color coordinates W' and the color temperatures WT' of white which has been distorted by the external light based on the calculated color coordinates X'Y'Z'. The gamma curve setting unit 353 determines a RaGaBa gray scale set which is the closest to the color coordinate W of original white by the input digital video data RGB, from among the color coordinates W' of white that has been distorted by the external light, as an output RaGaBa gray scale and in real time determines an R gamma curve, a G gamma curve, and a B gamma curve for compensating for distorted colors into their original states based on the determined RaGaBa gray scale set with respect to any one of all gray scales, specific gray scales k, maximum gray scales, and gray scales exceeding a critical value.

The gamma curve converter 354 performs substantially the same function as the gamma curve converter 253 of FIG. 5 except that it maps input data and output data having an increased bit number.

The bit number restoration unit 355 restores the bit number of the output data that have been mapped by the gamma curve converter 354 into its original state.

Figure 13:
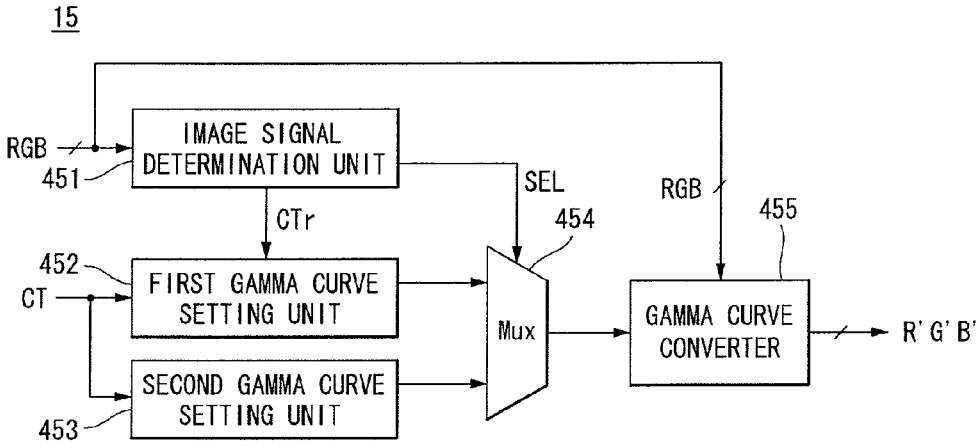
FIG. 13 is a diagram showing further yet another example of the gamma curve adjustment circuit shown in FIG. 3.

FIG. 13 shows further yet another example of the gamma curve adjustment circuit 15.

Referring to FIG. 13, the gamma curve adjustment circuit 15 comprises an image signal determination unit 451, a first gamma curve setting unit 452, a second gamma curve setting unit 453, a multiplexer 454, and a gamma curve converter 455.

The image signal determination unit 451 determines whether image signal color temperature information CTr is included in input digital video data RGB and generates a selection signal SEL with a different logic level according to a result of the determination. In other words, if, as a result of the determination, the image signal color temperature information CTr is determined to be included in the input digital video data RGB, the image signal determination unit 451 generates the selection signal SEL having a first logic level and extracts the image signal color temperature information CTr at the same time, and supplies the extracted image signal color temperature information CTr to the first gamma curve setting unit 452. However, if, as a result of the determination, the image signal color temperature information CTr is determined not to be included in the input digital video data RGB, the image signal determination unit 451 generates the selection signal SEL having a second logic level. Here, the image signal color temperature information CTr refers to information which is assigned to a data packet of the input digital video data RGB by several bits and is transmitted along with the input digital video data RGB.

The first gamma curve setting unit 452 differently sets pieces of gamma curve information for every image signal color temperature information CTr based on the image signal color temperature information CTr received from the image signal determination unit 451 and selects and outputs pieces of RGB gamma curve information of a range to which the external light color temperature CT received from the external light sensor 14 belongs. Meanwhile, the first gamma curve setting unit 452 may determine whether the image signal color temperature information CTr falls within a predetermined error range and, if, as a result of the determination, the image signal color temperature information CTr is determined not to fall within the predetermined error range, generates and outputs RGB gamma curve information for compensating for the image signal color temperature information CTr.

The second gamma curve setting unit 453 may be substituted with any one of the gamma curve setting units 252 and 353 shown in FIGS. 5 and 11.

The multiplexer 454 selects any one of the outputs of the first and second gamma curve setting units 452 and 453 in response to the selection signal SEL received from the image signal determination unit 451. That is, the multiplexer 454 may select the output of the first gamma curve setting unit 452 in response to the selection signal SEL having the first logic level and may select the output of the second gamma curve setting unit 453 in response to the selection signal SEL having the second logic level.

The gamma curve converter 455 performs substantially the same function as the gamma curve converter 253 of FIG. 5.

Figure 14:
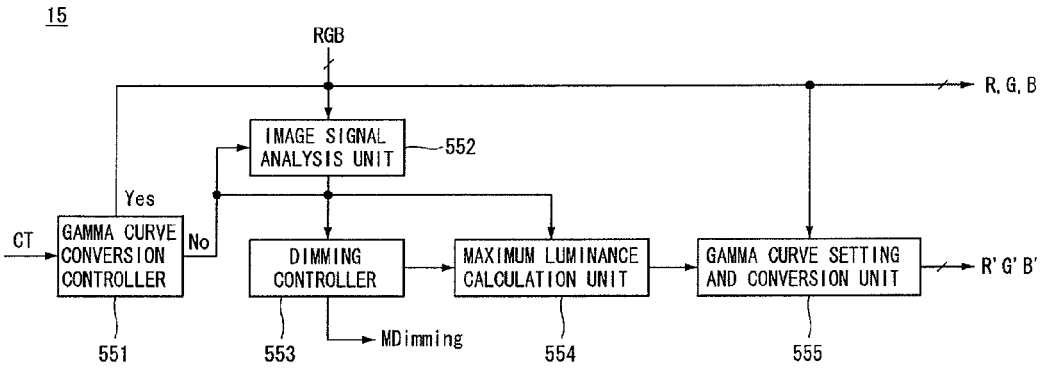
FIG. 14 is a diagram showing further yet another example of the gamma curve adjustment circuit shown in FIG. 3.

FIG. 14 shows further yet another example of the gamma curve adjustment circuit 15.

Referring to FIG. 14, the gamma curve adjustment circuit 15 comprises a gamma curve conversion controller 551, an image signal analysis unit 552, a dimming ratio adjustment unit 553, the maximum luminance calculation unit 554, and a gamma curve setting and conversion unit 555.

The gamma curve conversion controller 551 determines whether the input color temperature information CT received from the external light sensor 14 falls within a predetermined reference color temperature range and, if, as a result of the determination, the input color temperature information CT is determined to fall within the reference color temperature range (Yes), outputs the input digital video data RGB as they are without modulation. However, if, as a result of the determination, the input color temperature information CT is determined not to fall within the reference color temperature range, the gamma curve conversion controller 551 generates a signal (No) to instruct the operation of the image signal analysis unit 552 and the maximum luminance calculation unit 554.

The image signal analysis unit 552 comprises frame memory and functions to store the input digital video data RGB for every one frame, to analyze a gray scale-based histogram for the data RGB for the one stored frame and to extract data having maximum gray scales and data having minimum gray scales.

The dimming ratio adjustment unit 553 generates an adjustment dimming signal MDimming with reference to the maximum gray scale data and the minimum gray scale data output from the image signal analysis unit 552. The adjustment dimming signal MDimming is supplied to the backlight driver 16 and is used by the backlight driver 16 to control the luminance of the backlight 17.

The maximum luminance calculation unit 554 calculates a relative maximum white luminance of an input image according to the adjustment dimming signal MDimming.

The gamma curves setting and conversion unit 555 sets gamma curves with reference to external light color temperature and the calculated maximum white luminance and performs data mapping based on the set gamma curves. The gamma curves setting and conversion unit 555 may be replaced with each corresponding element described above with reference to FIGS. 5 to 13.

Figure 15:
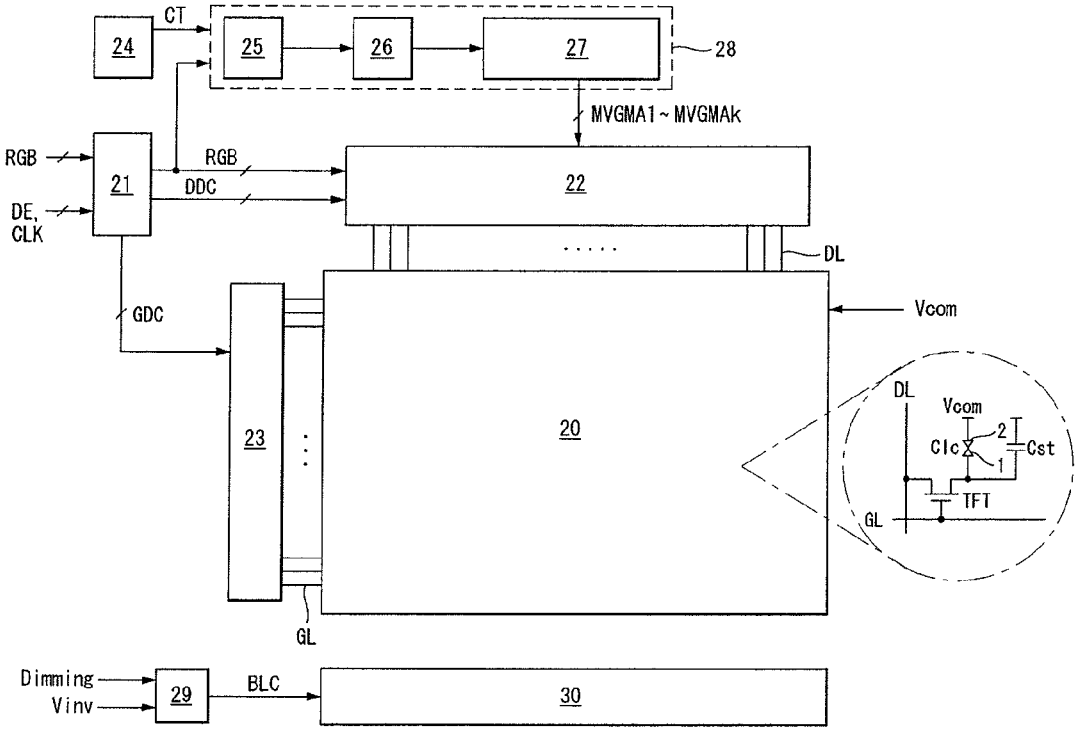
FIG. 15 is a block diagram of a liquid crystal display according to another embodiment of this document.
Figure 16:
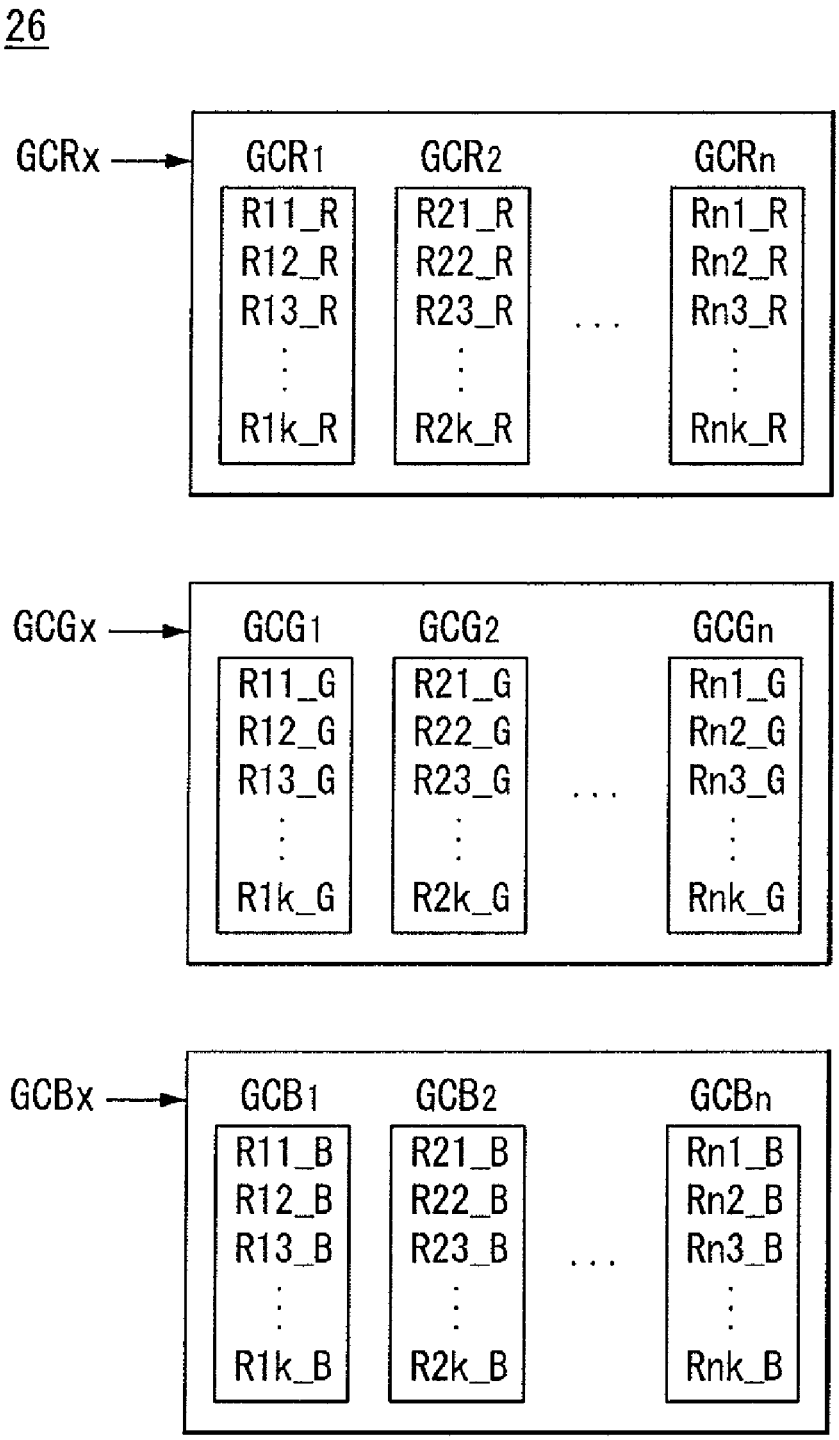
FIG. 16 is a diagram showing an example of a gamma resistance setting unit shown in FIG. 15.
Figure 17:
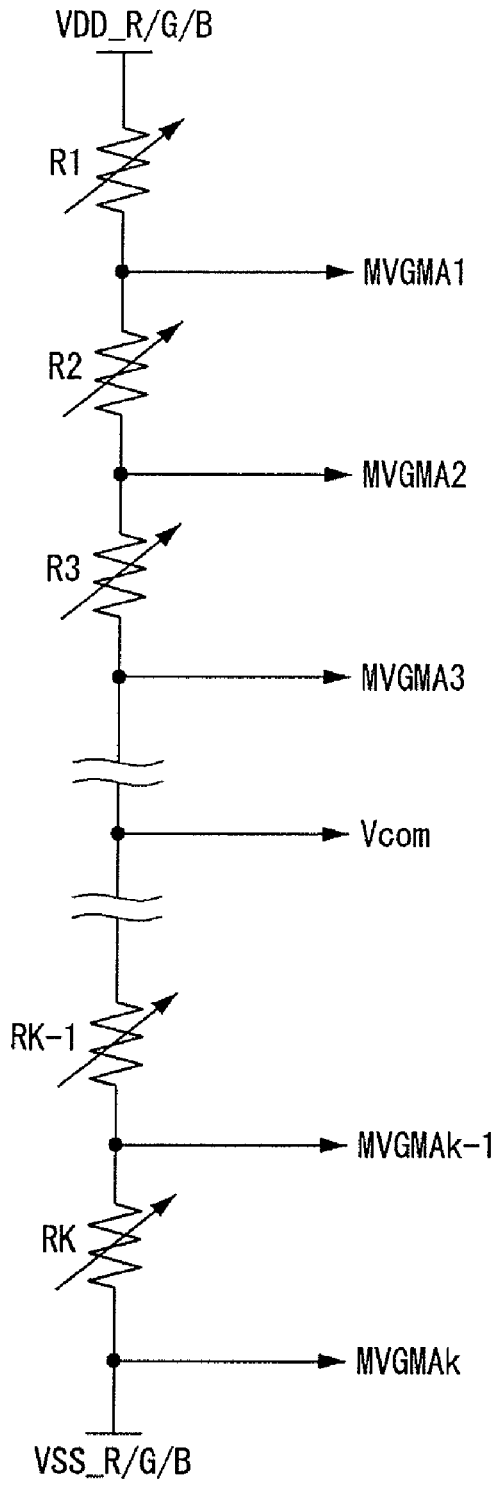
FIG. 17 is a diagram showing a gamma reference voltage converter of FIG. 15.

FIGS. 15 to 17 illustrate a liquid crystal display which is capable of reproducing the original color of an input image irrespective of a change in the viewing environments through a hardware method (control of a gamma resistance value of a gamma resistance string).

Referring to FIG. 15, the liquid crystal display according to another embodiment of this document comprises a liquid crystal display panel 20, a timing controller 21, a data driving circuit 22, a gate driving circuit 23, an external light sensor 24, a gamma curve adjustment circuit 28, a backlight driver 29, and a backlight 30. Here, the liquid crystal display panel 20, the timing controller 21, the gate driving circuit 23, the external light sensor 24, the backlight driver 29, and the backlight 30 perform substantially the same functions as the liquid crystal display panel 10, the timing controller 11, the gate driving circuit 13, the external light sensor 14, the backlight driver 16, and the backlight 17 of FIG. 5, respective.

The data driving circuit 22 converts input digital video data RGB into analog gamma compensation voltages based on adjustment gamma reference voltages MVGMA1 to MVGMAk received from the gamma curve adjustment circuit 28 in response to a data control signal DDC received from the timing controller 21 and supplies the analog gamma compensation voltages to the data lines DL of the liquid crystal display panel 20 as data voltages. A detailed construction of the data driving circuit 22 is substantially the same as that 12 of FIG. 5.

The gamma curve adjustment circuit 28 modulates gamma curves by changing the resistance values of variable resistors which constitute a gamma resistance string based on external light color temperature CT or a backlight dimming ratio according to an input image in order to constantly maintain the original color of the input image which is felt by a user irrespective of a change in the viewing environments. To this end, the gamma curve adjustment circuit 28 comprises a gamma curve setting unit 25, a gamma resistance setting unit 26, and a gamma reference voltage converter 27.

The gamma curve setting unit 25 may be replaced with any one of the construction of the gamma curve setting unit 151 shown in FIG. 4, the construction comprising the gamma curve conversion controller 251 and the gamma curve setting unit 252 of FIG. 5, the construction comprising the gamma curve conversion controller 351, the bit number extension unit 352, and the gamma curve setting unit 353 of FIG. 11, the construction comprising the image signal determination unit 451, the first and second gamma curve setting units 451 and 452, and the multiplexer 454 of FIG. 13, and the construction comprising the gamma curve conversion controller 551, the image signal analysis unit 552, the dimming ratio adjustment unit 553, and the maximum luminance calculation unit 554 of FIG. 14.

In this case, the gamma resistance setting unit 26 selects pieces of gamma resistance value determination information corresponding to the gamma curves determined by the gamma curve setting unit 25, from among pieces of predetermined gamma resistance value determination information R11 to R1k, . . . , Rn1 to Rnk corresponding to the pieces of gamma curve information GCR1 to GCRn, GCG1 to GCGn, and GCB1 to GCBn, respectively, as in FIG. 16 and outputs the pieces of selected gamma resistance value determination information in the form of electrical signals. The pieces of selected gamma resistance value determination information are used to vary the resistance values of the variable resistors which constitute the gamma resistance string within the gamma reference voltage converter 27 and are modulated into the determined gamma curves.

The gamma reference voltage converter 27 comprises three gamma resistance strings each comprising a number of the variable resistors R1 to RK for dividing voltage applied between a low power source voltage VSS and each of high voltage power source voltages VDD_R, VDD_G, and VDD_B as shown in FIG. 17. The resistance value of each of the variable resistors R1 to RK is electrically changed in response to the gamma resistance value determination information output from the gamma resistance setting unit 26. To this end, the variable resistors R1 to RK may be implemented using a known digital resistor or a variable resistor using a transistor. The adjustment gamma reference voltages MVGMA1 to MVGMAk are generated through nodes between the variable resistors R1 to RK. The RGB gamma curves are corrected by the adjustment gamma reference voltages MVGMA1 to MVGMAk, and so distorted color is restored into its original state.

As described above, the liquid crystal display of this document can reproduce the original color of a display image irrespective of a change in the viewing environments through a software method (input data modulation).

Further, the liquid crystal display of this document can reproduce the original color of a display image irrespective of a change in the viewing environments through a hardware method (control of gamma resistance values of a gamma resistance string).

The foregoing embodiments and advantages are merely exemplary and are not to be construed as limiting this document. The present teaching can be readily applied to other types of apparatuses. The description of the foregoing embodiments is intended to be illustrative, and not to limit the scope of the claims. Many alternatives, modifications, and variations will be apparent to those skilled in the art. In the claims, means-plus-function clauses are intended to cover the structures described herein as performing the recited function and not only structural equivalents but also equivalent structures. Moreover, unless the term "means" is explicitly recited in a limitation of the claims, such limitation is not intended to be interpreted under 35 USC 112(6).

What is claimed is:

1. A liquid crystal display, comprising:

a liquid crystal display panel displaying an image;

an external light sensor sensing a color temperature of external light around the liquid crystal display panel;

a backlight having an output luminance controlled in response to an adjustment dimming signal which is varied according to an input image; and a gamma curve adjustment circuit restoring an original color of the display image irrespective of a change in viewing environments by modulating input digital video data based on the color temperature of the external light or a relative maximum white luminance for the adjustment dimming signal.

2. The liquid crystal display of claim 1, wherein the gamma curve adjustment circuit comprises:

a gamma curve setting unit selecting pieces of RGB gamma curve information corresponding to input color temperature information with reference to pieces of R gamma curve information pieces of G gamma curve information, and pieces of B gamma curve information for every predetermined external light color temperature;

a storage unit comprising a number of look-up tables corresponding to the pieces of R gamma curve information, the pieces of G gamma curve information, and the pieces of B gamma curve information in a one-to-one manner; and a gamma curve converter generating modulation digital video data by mapping the input digital video data to data which are registered with the respective look-up tables in a one-to-one manner using the look-up tables corresponding to the pieces of selected RGB gamma curve information.

3. The liquid crystal display of claim 1, wherein the gamma curve adjustment circuit comprises:

a gamma curve conversion controller determining whether color temperature information received from the external light sensor falls within a predetermined reference color temperature range and, if, as a result of the determination, the color temperature information is determined not to fall within the predetermined reference color temperature range, generating an operation signal;

a gamma curve setting unit, in response to the operation signal, calculating color coordinates of the input digital video data which have been distorted by the external light and color coordinates of white which has been distorted by the external light with respect to all gray scales, determining an RGB gray scale set which is a closest to color coordinates of an original white by the input digital video data, from among the color coordinates of the distorted white, as output RGB gray scales, and in real time determining R gamma curves, G gamma curves, and B gamma curves for compensating for the distorted color as an original state based on the determined RGB gray scales with respect to all the gray scales; and a gamma curve converter generating modulation digital video data by mapping the input digital video data to the determined RGB gamma curves in a one-to-one manner.

4. The liquid crystal display of claim 3, wherein the gamma curve converter performs 'luminance equality mapping' or 'brightness equality mapping with external light taken into consideration' on gray scales which have not been mapped so that a gamma curve of each of the input digital video data has a predetermined curve.

5. The liquid crystal display of claim 1, wherein the gamma curve adjustment circuit comprises:

a gamma curve conversion controller determining whether color temperature information received from the external light sensor falls within a predetermined reference color temperature range and, if, as a result of the determination, the color temperature information is determined not to fall within the predetermined reference color temperature range, generating an operation signal;

a gamma curve setting unit, in response to the operation signal, calculating color coordinates of the input digital video data which have been distorted by the external light and color coordinates of white which has been distorted by the external light with respect to specific k gray scales comprising minimum gray scales and maximum gray scales, determining an RGB gray scale set which is a closest to color coordinates of an original white by the input digital video data, from among the color coordinates of the distorted white, as output RGB gray scales, and in real time determining R gamma curves, G gamma curves, and B gamma curves for compensating for the distorted color as an original state based on the determined RGB gray scales with respect to the specific k gray scales; and a gamma curve converter generating modulation digital video data by mapping the input digital video data to the determined RGB gamma curves in a one-to-one manner.

6. The liquid crystal display of claim 5, wherein the gamma curve converter performs 'luminance equality mapping' or 'brightness equality mapping with external light taken into consideration' on gray scales which have not been mapped so that a gamma curve of each of the input digital video data has a predetermined curve.

7. The liquid crystal display of claim 5, further comprising:

a bit number extension unit extending a bit number of the input digital video data and supplying the extended bit number to the gamma curve setting unit in response to the operation signal; and a bit number restoration unit restoring a bit number of the input digital video data mapped by the gamma curve converter in a state in which the bit number of the input digital video data has been extended.

8. The liquid crystal display of claim 1, wherein the gamma curve adjustment circuit comprises:

a gamma curve conversion controller determining whether color temperature information received from the external light sensor falls within a predetermined reference color temperature range and, if, as a result of the determination, the color temperature information is determined not to fall within the predetermined reference color temperature range, generating an operation signal;

a gamma curve setting unit, in response to the operation signal, calculating color coordinates of the input digital video data which have been distorted by the external light and color coordinates of white which has been distorted by the external light with respect to only maximum gray scales, determining an RGB gray scale set which is a closest to color coordinates of an original white by the input digital video data, from among the color coordinates of the distorted white, as output RGB gray scales, and in real time determining R gamma curves, G gamma curves, and B gamma curves for compensating for the distorted color as an original state based on the determined RGB gray scales with respect to the maximum gray scales; and a gamma curve converter generating modulation digital video data by mapping the input digital video data to the determined RGB gamma curves in a one-to-one manner.

9. The liquid crystal display of claim 8, wherein the gamma curve converter performs 'luminance equality mapping' or 'brightness equality mapping with external light taken into consideration' on gray scales which have not been mapped so that a gamma curve of each of the input digital video data has a predetermined curve.

10. The liquid crystal display of claim 8, further comprising:

an image signal determination unit determining whether image signal color temperature information is included in the input digital video data and generating a selection signal having a different logic level according to a result of the determination;

a first gamma curve setting unit differently setting the pieces of gamma curve information for every image signal color temperature information and outputting R gamma curve information, G gamma curve information, and B gamma curve information of a range to which the external light color temperature belongs; and a multiplexer selecting any one of the output of the gamma curve setting unit and the output of the first gamma curve setting unit and supplying the selected output to the gamma curve converter in response to the selection signal.

11. The liquid crystal display of claim 1, wherein the gamma curve adjustment circuit comprises:

a gamma curve conversion controller determining whether color temperature information received from the external light sensor falls within a predetermined reference color temperature range and, if, as a result of the determination, the color temperature information is determined not to fall within the predetermined reference color temperature range, generating an operation signal;

a gamma curve setting unit, in response to the operation signal, calculating color coordinates of the input digital video data which have been distorted by the external light and color coordinates of white which has been distorted by the external light with respect to only gray scales exceeding a critical value, determining an RGB gray scale set which is a closest to color coordinates of an original white by the input digital video data, from among the color coordinates of the distorted white, as output RGB gray scales, and in real time determining R gamma curves, G gamma curves, and B gamma curves for compensating for the distorted color as an original state based on the determined RGB gray scales with respect to the gray scales exceeding the critical value; and a gamma curve converter generating modulation digital video data by mapping the input digital video data to the determined RGB gamma curves in a one-to-one manner, wherein the critical value gray scale is a gray scale having a greatest value, from among gray scales which are more sensitive to luminance distortion than to color distortion resulting from the external light, and the critical value becomes small with a higher luminance of a maximum gray scale and becomes great with a lower luminance of the maximum gray scale.

12. The liquid crystal display of claim 11, wherein the gamma curve converter performs 'luminance equality mapping' or 'brightness equality mapping with external light taken into consideration' on gray scales which have not been mapped so that a gamma curve of each of the input digital video data has a predetermined curve.

13. The liquid crystal display of claim 11, further comprising:

an image signal analysis unit storing input digital video data for one frame and extracting data having maximum gray scales and data having minimum gray scales by analyzing the data for the one frame;

a dimming ratio adjustment unit generating the adjustment dimming signal with reference to the maximum gray scale data and the minimum gray scale data; and a maximum luminance calculation unit calculating a maximum white luminance of the input image in response to the adjustment dimming signal and supplying the calculated maximum white luminance to the gamma curve setting unit.

14. A liquid crystal display, comprising:

a liquid crystal display panel displaying an image;

an external light sensor sensing a color temperature of external light around the liquid crystal display panel;

a backlight having an output luminance controlled in response to an adjustment dimming signal which is varied according to an input image; and a gamma curve adjustment circuit restoring an original color of the display image irrespective of a change in viewing environments by varying resistance values of variable resistors constituting a gamma resistance string based on the luminous intensity of the external light or a relative maximum white luminance for the adjustment dimming signal.

* * * * *